United States Patent [19]

Harper, Jr.

[11] Patent Number: 4,629,470

[45] Date of Patent: Dec. 16, 1986

[54] PROCESS FOR DYEING SMOOTH-DRY CELLULOSIC FABRIC

[75] Inventor: Robert J. Harper, Jr., Metairie, La.

[73] Assignee: The United States of America as represented by the Secretary of Agriculture, Washington, D.C.

[21] Appl. No.: 789,212

[22] Filed: Oct. 18, 1985

[51] Int. Cl.[4] ..... C09B 67/00

[52] U.S. Cl. ..... 8/585; 8/606; 8/181; 8/185; 8/188

[58] Field of Search ..... 8/496, 585, 181, 185, 8/188, 606

[56] References Cited

U.S. PATENT DOCUMENTS

| | | | |
|---|---|---|---|
| 2,003,960 | 6/1935 | Tonkin | 8/604 |
| 2,330,775 | 9/1943 | Bock | 8/120 |
| 2,403,019 | 7/1946 | Olpin | 8/61 |
| 3,198,595 | 8/1965 | Mawson et al. | 8/18 |
| 3,279,879 | 10/1966 | Ohme et al. | 8/17 |
| 3,788,804 | 1/1974 | Harper et al. | 8/18 |
| 3,807,946 | 4/1974 | Harper et al. | 8/18 |
| 3,853,459 | 12/1974 | Harper et al. | 8/18 |
| 3,871,817 | 3/1975 | Harper, Jr. et al. | 8/17 |
| 4,227,879 | 10/1980 | Huffman | 8/602 |
| 4,297,100 | 10/1981 | Koci et al. | 8/527 |
| 4,369,041 | 1/1983 | Dvorsky et al. | 8/532 |
| 4,455,147 | 6/1984 | Lewis et al. | 8/471 |
| 4,548,902 | 10/1985 | Hasler et al. | 436/2 |

FOREIGN PATENT DOCUMENTS 6096974 12/1979 Japan .

*Primary Examiner*—Paul Lieberman
*Assistant Examiner*—Brooks Alan Truskett
*Attorney, Agent, or Firm*—M. Howard Silverstein; David G. McConnell; Raymond C. Von Bodungen

[57] ABSTRACT

Processes for dyeing, print-dyeing and differentially dyeing smooth-dry cellulose containing fabric are disclosed. Cellulose containing fabric is treated with a solution of crosslinking agent and a reactive additive which can be either polyethylene glycol or choline quaternary. The resultant fabric can then be dyed with a cellulosic dye. Print-dyeing is accomplished by selective application of a choline quaternary to a fabric padded crosslinking agent or by printing with a combination of crosslinking agent and choline quaternary on an untreated cellulosic fabric. These treatments are then followed by curing and dyeing. Differential dyeing is accomplished by first treating separate yarns with different solutions containing crosslinking agent with and without choline quaternary, drying, knitting, curing and dyeing the knitted fabric.

18 Claims, No Drawings

PROCESS FOR DYEING SMOOTH-DRY CELLULOSIC FABRIC

FIELD OF THE INVENTION

This invention relates processes for dyeing smooth-dry cellulosic fabrics.

DESCRIPTION OF THE PRIOR ART

Cellulosic fabrics do not possess smooth-dry (durable press or wash wear) performance or dimensional stability. In order to acquire these properties, cellulosic fabric requires a chemical finish. The chemical agents used in these processes are known as crosslinking agents. Examples of some agents are dimethylol dihydroxyethyleneurea (DMDHEU) or dimethylol propylcarbamate (DMPC).

While treatment of cellulosic fabric with a crosslinking agent does make the fabric smooth drying and dimensionally stabilized, it reduces the affinity of cellulose for dyeing. Therefore, modern textile processes require fabric to be dyed first and then finished for smooth dry performance. When fabrics are crosslinked with common and readily available agents such as DMDHEU or DMPC subsequent dyeing has been unsuccessful.

Previously crosslinking agents and reactive additives have been utilized as a route to dyeable crosslinked fabrics. U.S. Pat. No. 3,788,804 teaches the use of crosslinking agents and hydroxycarboxylic acids to form crosslinked fabrics with acidic grafts and dyeing the fabric with basic dyes. Also, U.S. Pat. No. 3,807,946 teaches the use of crosslinking agents and a reactive additive such as triethanolamine to form a crosslinked fabric with a grafted amine and dyeing with an acid dye. U.S. Pat. No. 3,853,459 utilizes a treatment of crosslinking agent and polymer to form a durable-press fabric with a polymeric treatment and dyeing with a disperse dyestuff. These patents teach in common dyeing modified cellulosic fabrics with non-cellulosic dyestuffs. Consequently, the performance of these dyes on a cellulosic substrate is not as good as cellulose dyed with normal dyestuffs such as direct or reactive dyes which are usually used on cellulosic fabrics.

SUMMARY OF THE INVENTION

Process for dyeing smooth-dry cellulose containing fabrics are disclosed. One process for dyeing a smooth-dry cellulosic fabric comprises: padding the cellulosic fabric with an an aqueous finishing solution comprising sufficient concentrations of N-methylol crosslinking agent, acid catalyst and polyethylene glycol in order to impart smooth-dry and dye receptivity properties to the fabric. The fabric is then dried and cured for sufficient time at temperature to interact the components of the finish with the fabric dyed with a cellulosic dye. This process can be varied by substituting a choline quaternary for the polyethylene glycol in order to achieve comparable results. This process can also be used to dye a print on cellulosic fabric. In this case the process is varied by padding the fabric with crosslinking agent and then printing the fabric with choline quaternary. In another variation of the printing process it is possible to print with a formulation containing crosslinking agent and choline quaternary on an untreated cellulosic fabric. Fabric can also be differentially dyed by selectively padding different yarns with crosslinking solutions and without choline quaternary, drying, weaving, curing and then drying the fabric with the differentially treated yarns.

DESCRIPTION OF THE PREFERRED EMBODIMENTS

In the preferred embodiment the two following types of reactive additives can be used: (1) polyethylene glycol (PEG) is used as a reactive additive and (2) choline chloride is used as a reactive additive.

In order to produce smooth-dry cellulosic fabrics with (PEG) which are dyeable, a finish is used containing crosslinking agents or combinations of crosslinking agents, a suitable catalyst (usually acidic) and a PEG. PEG functions both as a reactive additive and a propping agent to make cellulose accessible for subsequent dyeing. The crosslinking agent performs a twofold function. First, it reacts with cellulose to produce a fabric with a required resilience. Second, it reacts chemically with the PEG to graft the PEG into the cellulose substrate, thus binding a substantial portion of the PEG to cellulose via the agent.

From a chemical point of view, the unique characteristic of this finish is the interaction between the cellulose fiber, crosslinking agent, and the PEG to produce a chemical matrix in which all three components are chemically bound together. In this approach, it is advantageous to use an agent with several reactive sites to improve the efficiency of the grafting reaction. These hydrophilic grafts maintain an advantageous structure in the crosslinked fabric making cellulosic sites accessible for subsequent dyeing. A particularly effective agent for this purpose is dimethylol dihydroxyethyleneurea (DMDHEU) because of its multiple reactive sites, widespread use in conventional finishing by the industry, and cost considerations. Other agents with multiple reactive sites which can be used are trimethylol acetylenediureine (3ACD), tetramethylol acetylenediureine (4ACD), methylol melamine (TMM), and methylol dicarbamate derived from pentaerythritol (XCP). In addition, difunctional agents such as dimethylol propylcarbamate (DMPC) can be employed provided the necessary ratio of PEG to crosslinking agent is utilized. Sufficient PEG to difunctional crosslinking agent such as DMPC is used because excess PEG leads to a depressed smooth-dry peformance yet insufficient PEG results in inadequate sites for dyeing.

Examples of representative structures of effective crosslinking agents are:

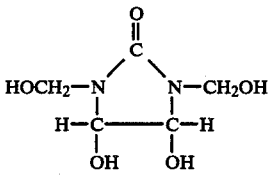

DMDHEU

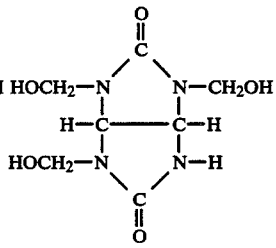

3 ACD

-continued

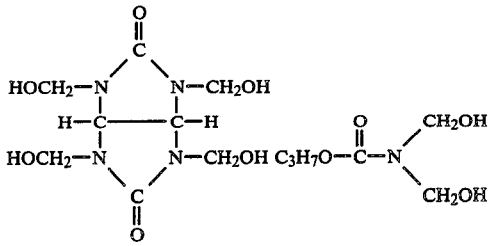

4 ACD DMPC

A second major component for this finish is PEG. Polyethylene glycols are commercial water soluble polymers formed by grafting ethylene oxide onto ethylene glycol. Molecular weights vary from a hundred to very high (20,000). In selecting PEG consideration is given to molecular weight, smooth-dry rating and amount of PEG grafted to cellulose matrix in order to obtain a good dyed fabric. Although all PEG's of varying molecular weight result in better dye absorption than a crosslinked control, the amount of improvement in dye absorption will decrease with increasing molecular weight. Similarly, a lesser increase in add-on will occur at very high PEG molecular weights. By contrast, smooth-dry ratings begin to drop off substantially with PEG molecular weights of 600 or less. On this basis, PEG's of molecular weight 600–1450 are preferred depending upon the level of smooth-dry performance desired. Fabrics with greater color intensity can be obtained by using mercerized fabrics.

In a second embodiment, choline chloride is used as a reactive additive. Therefore, the finish contains crosslinking agent or combination of agents, a suitable catalyst (usually acidic) and choline chloride. The presence of the choline chloride serves to make the finished fabric both accessible and attractive to certain cellulosic dyestuffs. Choline chloride (shown in the following chemical structure) contains both a reactive primary alcohol group as well as positively charged quaternary group.

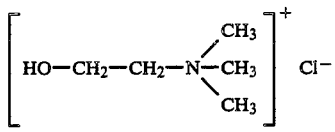

Because most common crosslinking agents function with acid catalysts, control of bath pH is necessary to insure adequate reactivity of the crosslinking agent with cellulosic substrate. Instead of chloline choride, choline base in which the associated anion with the quaternary group is hydroxyl can be used as reactive additive. However, neutralization to solution of proper pH requires the use of additional acid to achieve the desired bath pH. Similarly, other anionic groups could be substituted for chloride such as, for example, $Br^-$, $I^-$ or $SO_4^=$ or even organic groups such as citrates. The associated anion can be varied. With laundering of the crosslinked fabric the anion associated with the grafted quaternary is converted to the hydroxyl group.

Once grafted either with PEG or choline chloride, the fabric is dyed. To demonstrate the efficacy of the process, the efficiency of dye uptake is measured relative to cellulosic control.

Procedures based on the Kubelka-Munk equation are used to measure dye absorption. This procedure utilizes a dilute dye solution to determine the wavelength of maximum dye absorption of a given dyestuff. Reflectance of the dyed fabric is measured at that wavelength. In the Kubelka-Munk equation $$K/S = \frac{(1-R)^2}{2R}$$

K=light absorption coefficient
S=light scattering coefficient
R=reflectance or reflection factor K/S value is directly related to the color intensity of the fabric. Once reflectance, R, is determined, K/S can readily be calculated. The higher the K/S value, the greater the color depth and hence the greater the dye absorption in dyeing. For example, K/S value of mercerized cotton control is greater than that of untreated cotton control, reflecting the greater dyeability of cotton fabrics after mercerization.

K/S values are also used to approximate the amount of dye absorbed by a sample relative to that of cellulosic control, which is simultaneously dyed in the same dye bath. Thus, the K/S of a sample divided by the K/S of untreated cellulose control (either mercerized or unmercerized) times 100 equals the percent dye absorbed values:

The following four dye procedures are set forth to demonstrate the preferred embodiments. Dye procedures A and B are procedures used for dyeing with reactive dyes. In dye procedure A, 4 gms dye is used per 100 gms bath. In dye procedure B, 4 gms dye is used per 100 gms fabric. Dye procedure C is a procedure for dyeing cellulose with a direct dye. 2 gms dye per 100 gms fabric is used. Dye procedure D utilizes a mildly acidic wool dyeing bath process in which 2 to 4 gms of dye per 100 gms fabric is used and a maximum bath temperature of 60° C. is maintained.

Cellulosic fabric can be either prepared fabric (desized, scoured and bleached), mercerized or fabric which has been treated with liquid ammonia. Caustic mercerized fabric is preferable to achieve depth of shade in dyeing. A pad dry-cure treatment is applied to the selected cellulosic fabric. The finish comprises a crosslinking agent, catalyst, appropriate reactive additive and any selected auxiliaries such as wetting agents or softeners.

The fabric is then dried and cured and it can be washed if desired. The fabric is then dyed with a cellulosic dye such as a reactive or direct dye. The preferred embodiment allows for flexibility not heretofore known for smooth dry cellulosic fabric because now cellulosic fabric can be dyed either at the textile mill, garment manufacturer or retailer.

The amount of crosslinking agent and additive employed in the finish can be varied over a wide range depending upon level of smooth-dry performance and percent dye absorption required relative to a non-crosslinked cellulosic control.

In the case of choline chloride, as the reactive additive, fabrics with DP performance greater than untreated cellulose but less than true smooth-dry performance will show receptivity substantially greater than that of untreated cellulose. Under such conditions, this method offers a second utility for enhancing the dye receptivity of cellulosic fabrics.

Other applications arise in the case of choline chloride as a reactive additive. Because the dye procedure employed with this additive is one utilized in dyeing wool, cellulose-wool fabrics treated with crosslinking agent and choline chloride yield a DP cellulose-wool fabric that is dyed with a reactive dye in a single dyeing.

Another application in the case of choline chloride is to print on cellulosic fabric a formulation containing crosslinking agent, choline chloride thickner and acid catalyst. Once this mixture is dried and cured, the fabric is dyed using dye procedure D. Under these conditions, the printed areas are heavily dyed whereas the untreated areas are only lightly dyed, thus clearly delineating the print.

In another process variation, the fabric can be padded with a formulation containing crosslinking agent and acid catalyst, dried and then printed with a formulation containing choline quaternary. The fabric is cured, washed and dyed with a cotton dye in a mildly acidic dye bath. Under such conditions the printed areas are deeply dyed and the non-printed areas are dye resist. Similar treatment of crosslinking agent and choline quaternary can be utilized for fiber and yarn treatments. If such treated yarns are mixed with yarns which are untreated or treated with crosslinking agents without choline chloride in a fabric, an opportunity for cross-dyeing arises when said fabrics are dyed with cotton dyes in a mildly acidic dye bath.

The preferred embodiments of the invention are demonstrated but not limited to the following examples:

EXAMPLE 1

Cotton Print Cloth Treated with Crosslinking Agent (DMDHEU) and PEG and Dyed with Reactive Red 5 by Procedure A A pad bath (Bath A) was prepared containing 10% DMDHEU (solids), 0.8% zinc nitrate hexahydrate, and 0.1% nonionic wetting agent and remainder water. A second pad bath (Bath B) was prepared containing 10% DMDHEU (solids), 0.8% zinc nitrate hexahydrate, 0.1% wetting agent, 20% PEG 600 molecular weight and remainder water. A third pad bath (Bath C) was prepared the same as Bath B except that 20% PEG 1000 molecular weight was used. A fourth pad bath (Bath D) was prepared the same as Bath B except that the 20% PEG 1450 molecular weight was used. A fifth pad bath (Bath E) was prepared the same as Bath B except that PEG 3350 molecular weight was used. A sixth pad bath (Bath F) was prepared the same as Bath B except that 20% PEG 8000 molecular weight was used. A seventh pad bath (Bath G) was prepared the same as Bath B except that PEG 20,000 molecular weight was used. Each of these pad baths was used to pad a different sample of a desized, scoured and bleached cotton printcloth using 2-dips and 2-nips with 50 lb roll pressure on a 2-roll pad. Wet pickups of the seven different samples varied from 84–99%. The fabrics were then dried for 7 minutes at 60° C. and cured for 4 minutes at 160° C. These seven samples together with a sample of untreated printcloth were then laundered. Durable press ratings and add-ons for these seven samples are given in Table I. Furthermore, swatches of these fabrics were then dyed with a red fiber reactive dye for cotton (Reactive Red 5) using dye procedure A. The dyed samples were then rinsed and laundered and the reflectance values of these samples were measured at the point of maximum absorption of the dyestuff. These reflectance values, derived K/S values, and calculated percent dye absorption relative to the untreated cotton control are also reported in Table I. These data clearly demonstrate the positive impact of the PEG additives on post-dyeability characteristics of the crosslinked fabrics.

TABLE I

| PAD BATH | % DMDHEU | % PEG | MOL WT. OF PEG | % ADD-ON | DP RATING | % REFLECTANCE | K/S | % DYE ABSORBED[a] |
|---|---|---|---|---|---|---|---|---|
| A | 10 | 0 | | 5.4 | 4.8 | 33.0 | 0.68 | 6 |
| B | 10 | 20 | 600 | 13.6 | 3.5 | 4.6 | 9.89 | 90 |
| C | 10 | 20 | 1000 | 12.8 | 3.5 | 5.0 | 9.02 | 83 |
| D | 10 | 20 | 1450 | 13.0 | 4.8 | 6.6 | 6.61 | 60 |
| E | 10 | 20 | 3350 | 12.3 | 4.7 | 9.1 | 4.54 | 42 |
| F | 10 | 20 | 8000 | 11.3 | 4.8 | 8.5 | 4.93 | 45 |
| G | 10 | 20 | 2000 | 10.3 | 4.7 | 10.1 | 4.00 | 37 |
| UNTREATED COTTON | | | | 0 | 1.0 | 4.2 | 10.93 | 100 |

[a]% dye absorbed is obtained by dividing K/S of a sample by the K/S of the untreated cotton and multiplying by 100; dye procedure A was used with 4% dye on weight of dye bath; dyestuff is Reactive Red 5.

EXAMPLE 2

Mercerized Cotton Fabric Treated with Crosslinking Agent (DMDHEU) and PEG and Dyed with Reactive Red 5 by Procedure A Pad bath formulations A through E, treatment, launderings, and dyeings with Reactive Red 5 utilized in Example 1 were repeated, using five different samples of mercerized cotton printcloth. The data derived from this experiment are given in Table II and clearly demonstrate the total improvement in dyeability (K/S values) due to use of mercerized fabrics and the positive impact of PEG-additives on percent dye absorbed by crosslinked fabrics. Results clearly demonstrate utility of this process for producing post-dyeable durable press cotton fabrics when evaluated against mercerized printcloth control.

TABLE II

| PAD BATH | % DMDHEU | % PEG | MOL WT OF PEG | % ADD-ON | DP RATING | % REFLECTANCE | K/S | % DYE ABSORBED[a] |
|---|---|---|---|---|---|---|---|---|
| A | 10 | 0 | 0 | 7.2 | 4.3 | 27.9 | 0.93 | 5 |
| B | 10 | 20 | 600 | 15.8 | 3.3 | 2.8 | 16.87 | 89 |
| C | 10 | 20 | 1000 | 15.3 | 3.5 | 2.7 | 17.53 | 92 |
| D | 10 | 20 | 1450 | 18.9 | 4.1 | 3.3 | 14.17 | 75 |
| E | 10 | 20 | 3350 | 18.7 | 4.3 | 3.6 | 12.91 | 68 |
| UNTREATED COTTON | | | | 0 | 1.0 | 2.5 | 19.01 | 100 |

[a]Dye procedure A was used with 4% Dye on weight of dye bath; dyestuff is Reactive Red 5.

ratings fall below three with only 5% DMDHEU in the finish, percent dye absorbed is high. With 8% DMDHEU in the finish, DP rating is an acceptable 3.7 and dye absorption is 82.5% of an untreated cotton.

TABLE III

| PAD BATH | % DMDHEU | % PEG | MOL WT PEG | % ADD-ON | DP RATING | % REFLECTANCE | K/S | % DYE ABSORBED[1] |
|---|---|---|---|---|---|---|---|---|
| H | 8 | 15 | 1450 | 10.7 | 3.7 | 5.0 | 9.02 | 82.5 |
| I | 5 | 10 | 1450 | 5.9 | 2.8 | 4.4 | 10.39 | 95 |
| J | 5 | 20 | 1450 | 6.5 | 2.6 | 4.0 | 11.52 | 105 |

[1]Dye procedure A was used with 4% dye on weight of dye bath; dyestuff was Reactive Red 5.

EXAMPLE 3

Liquid Ammonia Treated Cotton Fabric Treated with Crosslinking Agent (DMDHEU) and PEG and Dyed with Reactive Red 5 by Procedure A Pad baths A, D, and E used in Example 1 were padded to three different samples of liquid ammonia treated cotton fabric. The three fabric samples were dried, cured, laundered, and dyed as in Example 1. All fabrics had DP ratings greater than 4.0 The percent dye absorbed relative to a nontreated liquid ammonia control was: 7% for treatment A (crosslinked control); 35% for treatment D using PEG 1450; and 30% for treatment E using PEG 3350. This demonstrated positive effect of PEG additives for post dyeing of DP cotton fabrics.

EXAMPLE 4

Cotton Printcloth Treated with Moderate Levels of Crosslinking Agent (DMDHEU) and PEG and Dyed with Reactive Red 5 by Procedure A A bath (bath H) was prepared containing 8% DMDHEU, 0.7% zinc nitrate hexahydrate, and 0.1% wetting agent, 15% PEG 1450 molecular weight and the remainder water. Another pad bath (bath I) containing 5% DMDHEU, 0.4% zinc hexahydrate, 0.1% wetting agent, 10% PEG 1450 molecular weight and the remainder water. Another pad bath (bath J) was prepared containing 5% DMDHEU, 0.4% zinc nitrate hexahydrate, 0.1% wetting agent, 20% PEG 1450, and the remainder water.

Each of these three pad baths was then padded to three different samples of a desized, scoured and bleached cotton print cloth as was done in Example 1. The fabrics were then dried and cured as in Example 1. The samples were then laundered, washed and swatches of each were dyed with Reactive Red 5 as in Example 1. The result of these experiments in terms of DP rating, add-on, reflectance, K/S values and % dye absorbed relative to a nontreated cotton control sample are given in Table III. These results show that while DP

EXAMPLE 5

Mercerized Cotton Fabric Treated with Moderate Levels of Crosslinking Agent (DMDHEU) and PEG and Dyed with Reactive Red 5 by Procedure A The same treatments using baths, H, I, and J of Example 4 were applied to three different samples of mercerized printcloth. The fabrics were dried, cured, laundered, and swatches dyed as in Example 1. The results of this experiment, as reported in Table IV, clearly demonstrated the process for producing post-dyeable durable press fabrics since DP values were acceptable and % dye absorbed was 77–100% of an untreated cotton. A further advantage of these treatments is the decrease in amount of chemicals employed and hence reduction of cost of finishing.

TABLE IV

| PAD BATH | % DMDHEU | % PEG | MOL WT PEG | % ADD-ON | DP RATING | % REFLECTANCE | K/S | % DYE ABSORBED[a] |
|---|---|---|---|---|---|---|---|---|
| H | 8 | 15 | 1450 | 11.9 | 3.6 | 3.1 | 15.14 | 80 |
| I | 5 | 20 | 1450 | 8.9 | 2.5 | 2.5 | 19.01 | 100 |
| J | 5 | 10 | 1450 | 6.9 | 3.7 | 3.2 | 14.64 | 77 |

[a]Dye procedure A with 4% dye on weight of dye bath; dyestuff is Reactive Red 5.

EXAMPLE 6

Cotton Printcloth Treated with Crosslinking Agent (DMPC) and PEG and Dyed with Reactive Orange 4 by Procedure A A series of formulations was prepared analogous to formulations A, D, E, F, and G of Example 1 except that the crosslinking agent was 10% DMPC and the pH of all baths was 4.0. Five different samples of cotton printcloth were padded using these bath formulations and then dried, cured, and laundered, following the same procedures employed in Example 1. Swatches of these fabrics together with a sample of untreated cotton were then dyed with a Reactive Orange 4 using dye procedure A. In general, it was found that the fabrics treated with formulations containing PEG additives had DP ratings of 3.3–3.5 and were dyed orange whereas the sample treated with DMPC only exhibited a much greater degree of dye resist. This example shows that fabrics with smooth-dry properties and post-dyeability characteristics can be achieved using a combination of a carbamate crosslinking agent and a PEG additive.

EXAMPLE 7

Mercerized Cotton Fabric Treated with Crosslinking Agent (DMPC) and PEG and Dyed with Reactive Red 5 by Procedure A Three formulations were prepared analogous to formulations A, D, and E in Example 1 except that the crosslinking agent was 10% DMPC and the pH of all baths was 4.0. Three different samples of mercerized cotton printcloth were padded with these formulations and then dried, cured and laundered following the same procedures as employed in Example 1. Swatches of these samples together with an untreated mercerized control were then dyed with the same reactive dye as used in Example 1. Durable press ratings, add-on, reflectance, K/S values, and % dye absorbed of these fabrics are given in Table V. These results clearly demonstrate that fabrics with smooth-dry properties and improved dye receptivity subsequent to crosslinking can be obtained using a finish containing a carbamate crosslinking agent and PEG additive.

TABLE V

| % DMPC | % PEG | MOL WT PEG | % ADD-ON | DP RATING | % REFLECTANCE | K/S | % DYE ABSORBED[a] |
|---|---|---|---|---|---|---|---|
| 10 | 0 | 0 | 7.1 | 4.0 | 8.9 | 4.66 | 24 |
| 10 | 20 | 1450 | 14.3 | 2.8 | 3.1 | 15.14 | 80 |
| 10 | 20 | 3350 | 13.9 | 2.8 | 3.1 | 15.14 | 80 |

[a]Dye procedure A was used with 4% dye on weight of dye bath; dyestuff is Reactive Red 5.

EXAMPLE 8

Cotton Printcloth Treated with Crosslinking Agent (DMPC) and PEG and Dyed with a Direct Cotton Dye by Procedure C Three swatches of undyed fabric from Example 6 were dyed with a direct cotton dye (Solophenyl Brilliant Green 5GL) using a dyeing procedure for direct dyes (dye procedure C). After the swatches were rinsed, laundered, and tumble dried, inspection revealed that fabric treated with DMPC only showed much greater resist to dyeing than the samples treated with DMPC and PEG, which were dyed a much deeper green. This example demonstrates that the processed developed can be applied to other dye types, specifically direct in this case.

EXAMPLE 9

Mercerized Cotton Fabric Treated with Crosslinking Agent (DMDHEU) and PEG and Dyed with a Direct Cotton Dye by Procedure C Three swatches of fabrics treated with pad baths A, D, E in Example 2 and untreated mercerized printcloth control were dyed with the same direct dye and procedure as used in Example 8. After the fabrics were rinsed, laundered, and tumble dried, inspection revealed that the fabrics treated with DMDHEU and PEG additive were dyed to a much greater degree than fabric treated with DMDHEU only, which was only faintly dyed and exhibited considerable dye resist. This experiment demonstrates that fabrics treated with DMDHEU and PEG additives possess' DP performance and yet are post-dyeable.

EXAMPLE 10

Mercerized Cotton Fabric Treated with Moderate Levels of Crosslinking Agent (DMDHEU) and PEG and Dyed with Reactive Red 2 by Procedure B Five pad baths analogous to those in Example 1 were prepared. Each pad bath contained DMDHEU, PEG additive, zinc nitrate hexahydrate catalyst, 0.1% nonionic wetting agent, and remainder $H_2O$ as shown in Table V. Mercerized cotton printcloth was padded with these formulations, dried, cured and washed as in Example 1, then dyed with Reactive Red 2 using dye procedure B. This is a reactive dye procedure using 4% dye based on the weight of fabric being dyed. The results as given in Table VI demonstrate the positive impact of the PEG additive on the post dyeability of crosslinked fabric. As a point of reference, fabric treated with DMDHEU only showed 1% dye absorptivity by this procedure.

TABLE VI

| % DMDHEU | % PEG | MOL WT PEG | % ADD-ON | DP RATING | K/S | % DYE[1] ABSORBED | ZINC NITRATE CATALYST |
|---|---|---|---|---|---|---|---|
| 5 | 15 | 1450 | 8.4 | 3.0 | 2.17 | 43 | 0.4 |
| 6 | 20 | 1450 | 8.9 | 2.8 | 2.57 | 52 | 0.5 |
| 7 | 20 | 1450 | 9.7 | 2.5 | 2.30 | 46 | 0.6 |
| 6 | 15 | 1000 | 7.9 | 2.9 | 3.13 | 63 | 0.5 |
| 6 | 20 | 1000 | 8.5 | 2.3 | 3.33 | 67 | 0.5 |
| MERCERIZED COTTON CONTROL | | | — | 1.0 | 4.99 | 100 | |

[a]Dye procedure B was used with 4% Dye based on weight of fabric being dyed.

EXAMPLE 11

Mercerized Cotton Fabric Treated with Crosslinking Agent (DMPC) and PEG and Dyed with Reactive Red 2 by Procedure B Seven pad baths were prepared using the concentrations of DMPC and PEG described in Table VII. Each pad bath contained zinc nitrate hexahydrate catalyst, as shown in Table VII. In addition, each contained 0.1% nonionic wetting agent, and the remainder water. One bath contained an additional component (14% $NaNO_3$). Seven different samples of mercerized cotton printcloth were padded with these formulations, dried, cured, and washed as in Example 1. These samples were dyed with Reactive Red 2 using dye procedure B The results in terms of K/S values and dye absorbed as given in Table VII demonstrate the positive effect of PEG on the post-dyeability of the crosslinked fabrics.

TABLE VII

| % DMPC | % PEG | MOL WT PEG | % ADD-ON | DP RATING | K/S | % DYE[1] ABSORBED | ZINC NITRATE |
|---|---|---|---|---|---|---|---|
| 10 | 10 | 1450 | 9.1 | 3.6 | 1.78 | 36 | 0.8 |
| 10 | 10 | 1000 | 9.1 | 3.6 | 1.85 | 37 | 0.8 |
| 8 | 5 | 1450 | 6.5 | 3.8 | 1.40 | 28 | 0.7 |
| 8 | 10 | 1450 | 6.5 | 3.6 | 1.99 | 40 | 0.7 |
| 8 | 10[2] | 1450 | 7.9 | 3.4 | 2.32 | 46 | 0.7 |
| 8 | 5 | 1000 | 6.4 | 3.6 | 1.52 | 30 | 0.7 |
| 8 | — | — | 4.3 | 4.0 | 0.48 | 10 | 0.7 |
| MERCERIZED COTTON CONTROL | | | — | 1.0 | 4.99 | 100 | — |

[1]Dye procedure B with 4% dye based on weight of fabric being dyed.
[2]Formulation contained 14% $NaNO_3$ in addition to other components.

EXAMPLE 12

Mercerized Cotton Fabric Treated with Various Crosslinking Agents and Choline Chloride and Dyed with Reactive Red 2 by Procedure B A series of pad baths was prepared as described in Table VIII. Mercerized cotton printcloth was padded with these formulations then dried, cured and laundered as in Example 1. The fabrics were then dyed with Reactive Red 2 (together with the untreated fabric) using dye procedure B. The reflectance values were measured, K/S values were determined and percent dye absorbed were calculated. These results reported in Table VIII show the positive impact of the grafted choline chloride in terms of post-dyeability and increased dye absorbtivity over crosslinked cotton fabric.

TABLE VIII

| BATH | % CROSSLINKER | CROSSLINKER[1] | % CATALYST | CATALYST | % CC | BATH pH | DP RATING | K/S | % DYE ABSORBED[3] |
|---|---|---|---|---|---|---|---|---|---|
| L | 3 | 3 ACD | 2.1 | Mixed Cat[2] | 5 | 2.7 | 3.0 | 10.39 | 208 |
| M | 3 | TMM | 2.1 | " | 5 | 4.0 | 2.5 | 4.93 | 99 |
| N | 3 | 3 ACD | 2.1 | " | 0 | 2.7 | 2.7 | 0.96 | 19 |
| O | 8 | DMDHEU | 0.7 | Zinc Nitrate | 3 | 3.5 | 2.8 | 2.09 | 42 |
| P | 8 | DMDHEU | 0.7 | " | 5 | 3.5 | 2.5 | 3.03 | 61 |
| R | 8 | DMPC | 2.75 | " | 3 | 3.8 | 3.8 | 2.24 | 45 |
| S | 8 | DMPC | 2.75 | " | 5 | 3.0 | 3.7 | 1.94 | 39 |
| T | 9 | DMDHEU | 0.7 | " | 0 | 4.0 | 4.3 | 0.07 | 1 |
| K | 8 | DMPC | 0.7 | " | 0 | 4.0 | 4.0 | 0.51 | 10 |
| UNTREATED COTTON | | — | — | — | — | — | 1.0 | 4.99 | 100 |

ACD = trimethylol acetylenediureine, TMM = trimethylol melamine; CC = choline chloride.
[2]Mixed catalyst contained $MgCl_2.6H_2O$ and citric acid in a 10:1 ratio.
[3]Dye procedure B with 4% dye based on the weight of the fabric being dyed. Dye Reactive Red 2.

EXAMPLE 13

Additional Examples of Mercerized Cotton Fabric Treated with Various Crosslinking Agents and Choline Chloride and Dyed with Reactive Red 2 by Procedure B A series of pad baths was prepared as described in Table IX. Mercerized cotton printcloth was padded with these formulations, then dried, cured and washed as in Example 1. The fabrics were then dyed with Reactive Red 2 (together with untreated fabric) using dye procedure B. The reflectance values were measured, K/S values were determined and percent dye absorbed was calculated. These results reported in Table IX show the positive impact of the grafted quaternary groups both in terms of dyeing of DP fabrics and in enhancing the dyeability of cellulosic fabrics.

TABLE IX

| BATH | % CROSS-LINKER | CROSS-LINKER | % CATALYST | % CC | BATH pH | DP RATING | K/S | % DYE ABSORBED |
|---|---|---|---|---|---|---|---|---|
| V | 4 | 3 ACD | 2.1 | 5 | 2.7 | 3.4 | 6.39 | 139 |
| W | 4 | DMPC | 2.1 | 5 | 3.2 | 2.9 | 10.65 | 231 |
| X | 4 | DMDHEU | 2.1 | 5 | 3.3 | 3.5 | 4.05 | 88 |
| Y | 4 | XCP | 2.1 | 5 | 3.5 | 3.5 | 3.03 | 66 |
| $Z_1$ | 2 | 3 ACD | 2.1 | 5 | 2.7 | — | — | — |
| $Z_2$ | 1 | 3 ACD | 2.0 | 4 | 3.5 | 2.4 | 12.9 | 288 |
| COTTON CONTROL | | — | — | — | — | — | 4.6 | 100 |

[1]3 ACD = trimethylol acetylenediureine, XCP = methylol of pentaerythritol carbamate, CC = choline chloride.
[2]Catalysts contained 2.0% of magnesium chloride hexahydrate and 0.1% of citric acid except for $Z_2$ which had 2.0% magnesium chloride hexahydrate only.
[3]Dye procedure B with 4% dye based on weight of fabric being dyed.

EXAMPLE 14

Mercerized Cotton Fabric Treated with Various Crosslinking Agents and Choline Chloride and Dyed with Direct Blue 1 by Dye Procedure C Swatches of samples from Examples 12 and 13 (Fabrics treated with baths L. M, N, V, W. X, Y) were dyed with Direct Blue 1 using dye procedure C (2% dye based on weight of fabric being dyed). Reflectance values of these samples were measured, K/S values were determined and percent dye absorbed were calculated. The results reported in Table X clearly show the positive impact of grafted quaternary groups both in terms of dyeing of DP fabrics and in enhancing the total dyeability of cellulosic fabrics

TABLE X

| BATH | TREATMENT[1] | % ADD-ON | DP RATING | K/S | % DYE ABSORBED[2] |
|---|---|---|---|---|---|
| L | 3% 3 ACD, 5% CC | 2.6 | 3.0 | 17.53 | 173 |
| M | 3% TMM, 5% CC | 2.6 | 2.5 | 10.39 | 103 |
| N | 3% 3 ACD | 1.3 | 2.7 | 1.59 | 16 |
| V | 4% 3 ACD, 5% CC | 2.6 | 3.4 | 14.17 | 140 |
| W | 4% DMPC, 5% CC | 2.0 | 2.9 | 16.26 | 161 |
| X | 4% DMDHEU, 5% CC | 2.6 | 3.5 | 13.30 | 131 |
| Y | 4% XCP, 5% CC | 3.3 | 3.5 | 9.66 | 95 |
| MERCERIZED COTTON CONTROL | | — | 1.0 | 10.13 | 100 |

[1]3 ACD = trimethylol acetylenediureine
TMM = trimethylol melamine
XCP = methylol of pentaerythritol dicarbamate
CC = choline chloride
[2]Dye procedure C was used with 2% dye based on weight of fabric being dyed.

EXAMPLE 15

Mercerized Cotton Fabric Treated with Various Crosslinking Agents and Choline Chloride and Dyed with Reactive Red 2 by Procedure D (Wool Dye Procedure)

Swatches of samples from Examples 12 and 13 (Fabrics treated with Baths L, V, W, $Z_1$ and $Z_2$) were dyed with Reactive Red 2 using dye procedure D (Wool Dye Procedure-4% dye based on weight of fabric). Reflectance values of these samples were determined and percent dye absorbed calculated. The results as given in Table XI clearly demonstrate that these crosslinked fabrics can be dyed subsequent to crosslinking. In addition, the values of % dye absorbed (up to 400% of that bound to cotton using basic catalysis) clearly demonstrated the enhancement of dyeing efficiency in this system. Moreover, because under these conditions (acidic dye procedure) was untreated cotton is relatively undyed (5% dye uptake relative to normal cotton dyeing), this procedure has implications for crossdyeing and other areas in which only part of the cellulosic fabric is treated.

TABLE XI

| PAD | TREATMENT | % ADD-ON | DP RATING | K/S | % DYE ABSORBED[2] |
|---|---|---|---|---|---|
| L | 3% 3 ACD, 5% CC | 2.6 | 3.0 | 18.24 | 396 |
| V | 4% 3 ACD, 5% CC | 2.6 | 3.4 | 16.26 | 353 |
| W | 4% DMPC, 5% CC | 2.0 | 2.9 | 15.14 | 329 |
| $Z_1$ | 2% 3 ACD, 5% CC | 0.7 | 2.8 | 18.24 | 396 |
| $Z_2$ | 1% 3 ACD, 4% CC | 1.3 | 2.4 | 12.53 | 280 |
| MERCERIZED COTTON CONTROL | | — | 1.0 | 0.21 | 5 |

[1]3 ACD = trimethylol acetylendiureine
CC = choline chloride
[2]Dye procedure D was with 4% dye based on weight of fabric being dyed. % dye absorbed based on mercerized cotton control using basic catalysis. K/S = 4.60 was taken as 100%.

EXAMPLE 16

Cotton-Polyester Blend Fabric Treated with Crosslinking Agent and Choline Chloride and Dyed with Reactive Red 2 by Procedure D Samples of a 50% cotton-50% polyester sheeting fabric were treated with one of the following pad baths (Baths $Z_1$ and $Z_2$) as described in Table IX. The samples were then dried, cured and washed as in Example 1. Samples of these fabrics were then dyed with Reactive Red 2 together with untreated fabric using dye procedure D. Inspection of these samples showed that the cellulosic component was dyed but the polyester component was undyed. The reflectance values were measured, K/S values were determined and the percents dye absorbed as given in Table XII show the positive impact of the grafted quaternary in enhancing the dyeability of the cellulosic component of a blend fabric.

TABLE XII

| PAD BATH | TREATMENT | DP RATING | K/S | ABSORBED[2] |
|---|---|---|---|---|
| $Z_1$ | 2% 3 ACD, 5% CC | 4.1 | 8.29 | 568 |
| $Z_2$ | 1% 3 ACD, 4% CC | 3.3 | 8.12 | 556 |
| BLEND CONTROL | | 2.5 | .06 | 4 |

[1]3-ACD = trimethylol acetylenediureine.
CC = choline chloride.
[2]Dye procedure D was used with 4% dye based on weight of fabric being dyed. Under basic catalysis with 4% Reactive Red 2, K/S value of blend was 1.46; which was calculated as 100% for control.

EXAMPLE 17

Mercerized Cotton Fabric Treated with Crosslinking Agent and Choline Chloride and Dyed with Direct Blue I by Procedure D Samples of swatches of mercerized cotton treated with baths L, V, W, X, $Z_1$, $Z_2$, + untreated control were dyed with Direct Blue 1 using dye procedure D with 2% dye based on the weight of the fabric being dyed.

The reflectance values were measured and K/S values determined. The results are given in Table XIII. Under these conditions the control showed reduced dye receptivity in comparison to similar cotton dyed in a conventional manner (K/S=5.7). These results show that increased dye receptivity was observed with the cationic modified fabric and reduced dye receptivity was obtained with the untreated cotton. Therefore, this method can be used not only for increasing dye efficiency and the dyeing of crosslinked fabrics but also for different dyeing of treated and untreated components in the same fabric.

TABLE XIII

| PAD BATH | TREATMENT[1] | % ADD-ON | DP RATING | K/S |
|---|---|---|---|---|
| L | 3% 3 ACD, 5% CC | 2.6 | 3.0 | 7.65 |
| V | 4% 3 ACD, 5% CC | 2.6 | 3.4 | 6.97 |
| W | 4% DMPC, 5% CC | 2.0 | 2.9 | 10.39 |
| X | 4% DMDHEU, 5% CC | 2.6 | 3.5 | 9.02 |
| $Z_1$ | 2% 3 ACD, 5% CC | 0.7 | 2.8 | 9.89 |
| $Z_2$ | 1% 3 ACD, 4% CC | 1.3 | 3.4 | 11.84 |
| UNTREATED MERCERIZED COTTON CONTROL | | — | 1.0 | 2.41 |

[1]3 ACD = trimethylol acetylenediureine, CC = choline chloride

[2]Dye procedure D was used with 2% dye based on weight of fabric being dyed. K/S of control with a moderate standard direct dye procedure was 5.7.

EXAMPLE 18

Mercerized Cotton Fabric Treated with Crosslinking Agent and Choline Chloride and Dyed with Reactive Blue 29 by Procedure D Swatches of mercerized cotton fabric treated with one of the following pad baths, P, R, S, T, & K as described in Table VIII were dyed with Reactive Blue 29 using dye procedure D using 4% dye based on the weight of the fabric in the dye bath. Inspection of the resulting fabrics, when compared to an untreated control fabric, showed that the fabrics treated with crosslinking agent and chloline chloride were dyed a deep blue whereas the untreated fabric was undyed. This experiment shows that treatments with choline chloride as a reactive additive in combination with crosslinking agent not only provides a route to dyeing fabric subsequent to crosslinking but also provides a route to differential dyeing and crossdyeing of fabrics because in this instance the untreated fabric was relatively undyed.

EXAMPLE 19

Cotton-Wool Blend Fabric Treated with Crosslinking Agent and Choline Chloride and Dyed with Reactive Red 2 by Procedure D A 60% cotton-40% wool fabric was padded with a formulation containing 5% trimethylol acetylenediureine (3 ACD), 5% choline chloride (CC), 2.5% magnesium chloride hexahydrate, 0.1% citric acid, 0.1% nonionic wetting agent and the remainder water.

The fabric was then dried, cured and washed as in Example 1. The fabric had DP rating of 4.0. The fabric, as well as an untreated control cotton-wool and untreated control cotton print cloth were dyed with Reactive Red 2 using dye procedure D.

The treated cotton-wool fabric was uniformly dyed a deep red, the untreated cotton-wool control was a variegated reddish color due to dyeing of the wool component whereas the untreated all-cotton control fabric was a pale pink. The K/S value for the choline chloride treated sample was 16.3 whereas the K.S value for the untreated cotton-wool sample was 2.3 and the untreated all cotton sample was 0.15.

These results clearly demonstrated the effectiveness of this procedure for producing smooth-drying cotton-wool fabric which can be dyed subsequent to crosslinking with a single dye procedure and dyestuff.

EXAMPLE 20

Application of Print Formulation Containing Crosslinking Agent and Choline Chloride to Various Fabrics and the Selective Dyeing of Printed Areas with Reactive Red 2 by Procedure D A print formulation was prepared that contained 4% trimethylol acetylenediureine (3 ACD), 5% choline chloride (CC), 0.5% hydroxyethylcellulose, 2% magnesium chloride hexahydrate, 0.1% citric acid, 0.1% nonionic wetting agent and the remainder water. This formulation was applied to cotton print cloth, a cotton twill and a 60% cotton-40% wool twill blend using an eye-dropper by printing certain words, letters and number on the samples. Samples were then dried, cured and laundered as in Example 1. These samples were dyed with Reactive Red 2 using dye procedure D.

In the case of the two all cotton samples the printed areas were dyed a deep red whereas the non-printed areas were dyed pale pink. In the case of the cotton-wool, the printed areas were dyed a deep red whereas the untreated areas were a varigated reddish. This experiment demonstrated that the application of the crosslinking treatment containing choline chloride permitted selective dyeing of certain regions or parts of a fabric.

EXAMPLE 21

Differential Dyeing with Reactive Red 2 of Knitted Fabrics Prepared from Treated and Untreated Yarns A pad bath was prepared containing 2% trimethylol acetylenediureine, 5% choline chloride, 2% magnesium chloride hexahydrate, 0.1% citric acid, 0.1% nonionic wetting agent and the remainder water. A mercerized cotton yarn was padded with this formulation using a yarn treatment apparatus and the padded yarn was dried. Then, this yarn and untreated mercerized yarn were used to knit a jersey tube. Treated and untreated yarns were alternated every two inches in the fabric. The fabric was then pressed, and cured for 3 minutes at 160° C. and laundered. A one foot length of the fabric was then dyed with Reactive Red 2 using dye porcedure D to produce a striped fabric.

Results showed the segments of fabric treated with crosslinking agent and choline chloride dyed a deep red whereas the untreated cotton was lightly dyed. This experiment demonstrates the achievement of a crossdye effect in a single fabric using a yarn treatment with a combination of crosslinking agent and choline chloride to form yarns with grafted quaternary sites. These sites were dyed with cotton dyes in a mildly acid wool dye bath. Under the same conditions, untreated cotton yarns in the same fabric were only lightly dyed.

EXAMPLE 22

Differential Dyeing with Reactive Blue 29 of Knitted Fabrics Prepared from Treated and Untreated Yarns A one foot length of undyed cotton knit fabric as prepared in Example 21 was dyed with Reactive Blue 29 using dye procedure D. There was obtained a striped fabric in which the segments treated with crosslinking agent and choline chloride were dyed a deep blue, whereas the untreated cotton was dyed a pale, light blue. This experiment demonstrated that the achievement of a crossdye effect in a single fabric using a yarn treatment with a combination of crosslinking agent and choline chloride to produce yarns with grafted quaternary sites. These sites were dyed with a cotton dye in a mildly acidic dye bath. Under the same conditions, untreated cotton yarns in the same fabric are lightly dyed, thus leading to crossdyed fabric.

EXAMPLE 23

Differential Dyeing Using Reactive Red 2 on Knitted Fabrics Prepared from Separately Treated Yarns A pad bath was prepared containing 2% trimethylol acetylenediureine, 5% choline chloride, 2% magnesium chloride hexahydrate, 0.10% citric acid, 0.1% nonionic wetting agent and the remainder water. A mercerized cotton yarn was padded with this formulation using a yarn treatment apparatus and the padded yarn was dried. A second pad bath was prepared containing 3% trimethylol acetylenediureine, 2% citric acid, 0.2% magnesium chloride hexahydrate, 0.1% nonionic wetting agent and the remainder water. A second mercerized cotton yarn was padded with this second formulation using a yarn treatment apparatus and the padded yarn was dried. Then, these separate yarns were knitted into a jersey tube in which the two separately treated yarns were alternated in the knit after each two inch segment. The final knitted fabric was then pressed, cured for 3 minutes at 160° C. and laundered. A one foot length of this fabric was then dyed with Reactive Red 2 using dye procedure D. There was produced a red and white striped fabric. The segments of the fabric made from yarn treated with crosslinking agent and choline quaternary were dye receptive and therefore dyed a deep red whereas the segment treated with crosslinking agent and citric acid were dye resist and therefore remained undyed.

This experiment demonstrated a crossdyeable smooth-drying cotton fabric which was crossdyeable.- The crossdyeing occurred because of the affinity of dye for crosslinked fabric segments with grafted quaternary groups and its non-affinity for crosslinked segments without grafted quaternary groups.

EXAMPLE 24

Differential Dyeing with Reactive Blue 29 of Knitted Fabrics Prepared from Separately Treated Yarns A one foot segment of cured and laundered undyed cotton knit fabric as prepared in Example 23 was dyed with Reactive Blue 29 using dye procedure D. A blue and white striped fabric was produced. The segments of the fabric made from yarn treated with crosslinking agent and choline quaternary were dyed a deep blue whereas the segments treated with crosslinking agent without quaternary graft were dye resist. This experiment demonstrated a crossdyeable smooth-drying cotton fabric. The crossdyeing occurred because of the affinity of dye for the crosslinked yarns with grafted quaternary groups and its non affinity for crosslinked segments without grafted quaternary groups.

EXAMPLE 25

Sequential and Selective Addition of Choline Quaternary to Sensitized Fabric and Subsequent Dyeing with Reactive Blue 29

A pad bath was prepared comprising 4% trimethlol acetylenediureine, 2% magnesium chloride hexahydrate, 0.1% citric acid, 0.1% nonionic wetting agent and remainder water. A mercerized cotton fabric and a 60-% cotton-40% wool fabric were padded with the above formulation. The fabric where then dried for seven minutes at 60° C. Then, a print formulation was prepared comprising 5% choline chloride, and 0.5% hydroxyethylcellulose and the remainder water. Certain words and letters were then printed on the above fabrics using an eye dropper and the samples were then dried, cured and laundered as in Example 1. These fabrics were then dyed with Reactive Blue 29 using dye procedure D.

In the case of cotton the result was smooth-dry fabrics with dyed blue printed areas whereas non-printed areas remained undyed. In the case of the wool-cotton blend, the printed area was dyed a solid blue, whereas in the non-printed areas only the wool component was dyed blue. The result was a solid print with a varigated background. These results demonstrate that a differential dyeing effect can be achieved by sequential application of the crosslinking agent and choline chloride to the fabric. Further, it demonstrates the use of a crosslinking treatment without additive dye resist in certain areas of fabric while using an additive to achieve dyeing in the treated areas.

EXAMPLE 26

Sequential and Selective Addition of Choline Quaternary to Sensistized Fabric and Dyeing with Reactive Red 2

A sample of the cured, laundered and undyed cotton fabric from Example 25 was dyed with Reactive Red 2 using procedure D. This produced a smooth-dry fabric in which the areas printed with choline quaternary were dyed a deep red whereas the remainder of the fabric was undyed. These results demonstrate that a differential dyeing effect was achieved in that the areas of fabric with a choline quaternary print (and hence treated with crosslinking agent and quaternary) were dyed a deep red whereas the remainder of the fabric, which was treated with crosslinking agent only was undyed.

EXAMPLE 27

Dyeing of Cotton-Wool Blend Treated with Crosslinking Agent and Choline Quaternary with Reactive Blue 29

Samples of treated and untreated cotton-wool blend fabrics from Example 19 were dyed with Reactive Blue 29 using dye procedure D. The treated cotton-wool fabric was uniformly dyed a deep blue, whereas the untreated cotton-wool was varigated blue due to the dyeing of wool component and the non-dyeing of the cotton component. These results demonstrate that this procedure produces a smooth-dry cotton-wool fabric in which both components can be dyed subsequent to crosslinking in a single dye procedure.

I claim:

1. A process for dyeing a smooth-dry cellulose fabric comprising:

(a) padding a cellulose containing fabric with an aqueous finishing solution comprising sufficient concentrations of: N-methylol crosslinking agent, acid catalyst and choline quaternary compound to impart smooth-dry performance and dye receptivity properties to the fabric;

(b) drying and curing the cellulose containing fabric for sufficient time and at sufficient temperature to interact the component of the finish with the fabric; and then, (c) dyeing the fabric with a cellulosic dye.

2. The process of claim 1 wherein the fabric is dyed with a cellulosic dye in a mildly acidic wool dye bath.

3. The process of claim 2 wherein the cellulose containing fabric is selected from the group of: cotton, wool-cotton blend, cotton-synthetic blend, rayon, rayon-cotton blend and rayon-wool blend.

4. The process of claim 2 wherein the N-methylol crosslinking agent is selected from the group consisting of: dimethylol dihydroxyethyleneurea, trimethylol acetylenediureine, tetramethylol acetylenediurenine, methylol melamine, methylol dicarbamate and dimethylol propylcarbamate.

5. The process of claim 2 wherein the acid catalyst is selected from the group consisting of: zinc nitrate hexahydrate, magnesium chloride hexahydrate, and mixed catalyst of magnesium chloride hexahydrate and citric acid.

6. The process of claim 2 wherein the aqueous finishing solution includes a nonionic wetting agent of sufficient concentration to achieve efficient wetting of the cellulosic fabric.

7. The process of claim 2 wherein the padding solution contains from about 1 to 12% N-methylol crosslinking agent, 0.15 to 4% acid catalyst, and 0.5 to 8% choline salt.

8. The process of claim 2 wherein the pH of the finishing solution ranges from about 2.4 to 6.

9. The process of claim 7 wherein the anion component of the choline salt is selected from the group consisting of: chloride, bromide, iodide, sulfate, hydroxide and citrate.

10. A process for selectively dyeing a print on cellulose containing fabric comprising:

(a) padding a cellulose containing fabric with an aqueous finishing solution comprising sufficient concentrations of: N-methylol crosslinking agent and acid catalyst to impart smooth-dry performance to the fabric;

(b) drying the cellulose containing fabric for sufficient time at sufficient temperature to remove moisture;

(c) printing on the fabric with an aqueous solution comprising sufficient concentrations of choline quaternary compound to impart dye receptivity properties to the fabric;

(d) curing the fabric for sufficient time at sufficient temperature to interact the components of the printing solution with the fabric; and then, (e) dyeing the fabric with a cellulose dye.

11. The process of claim 10 wherein the fabric is dyed with a cellulosic dye in a mildly acidic wool dye bath.

12. The process of claim 11 wherein the aqueous printing solution comprises choline chloride and a thickening agent to improve print sharpness.

13. The process of claim 12 wherein the thickening agent is hydroxyethyl cellulose.

14. A process for selectively dyeing a print on cellulosic containing fabric comprising:

(a) printing on a cellulose containing fabric with an aqueous printing solution comprising sufficient concentrations of: N-methylol crosslinking agent, acid catalyst and a choline quaternary compound to impart dye receptivity properties to the printed area of the fabric;

(b) drying and curing the cellulose containing fabric for sufficient time and at sufficient temperature to interact the print solution with the fabric; and then, (c) dyeing the fabric with a cellulosic dye in a mildly acidic wool dye bath to achieve selective dyeing on the printed areas.

15. The process of claim 14 wherein the aqueous printing solution additionally contains a thickening agent to improve print sharpness.

16. The process of claim 15 wherein the thickening agent is hydroxyethyl cellulose.

17. A process for differentially dyeing a cellulose smooth-dry fabric comprising:

(a) padding a cellulosic yarn with an aqueous finishing solution comprising sufficient concentrations of: N-methylol crosslinking agent, acid catalyst and a choline quaternary compound to impart smooth-dry performance and dye receptivity to the yarn;

(b) drying the cellulosic yarn for sufficient time at sufficient temperature to remove moisture;

(c) padding another cellulosic yarn with an aqueous finishing solution comprising sufficient concentrations of: N-methylol crosslinking agent and acid catalyst to impart smooth-dry and dye resist properties to the yarn;

(d) drying the treated yarn of (c) for sufficient time at sufficient temperature to remove moisture;

(e) combining yarn (b) with yarn (d) so as to produce a fabric with preselected dye resist and dye receptive areas;

(f) curing the fabric at sufficient temperature for sufficient time to interact the finishing components with the fabric; and then, (g) dyeing the fabric with a cellulosic dye in a mildly acidic wool dye bath, thereby producing a differentially dyed, smooth-dry cellulosic fabric.

18. The process of claim 17 wherein the choline quaternary is choline chloride.

* * * * *